United States Patent [19]

Bastenhof

[11] 4,094,465

[45] June 13, 1978

[54] METHOD AND DEVICE FOR OBVIATING THE RISK OF INJECTION FUEL LEAKAGE, MORE PARTICULARLY INTO THE COOLING SYSTEM OF DIESEL ENGINE INJECTORS

[75] Inventor: Dirk Bastenhof, Eaubonne, France

[73] Assignee: Societe d'Etudes de Machines Thermiques S.E.M.T., Saint-Denis, France

[21] Appl. No.: 760,570

[22] Filed: Jan. 19, 1977

[30] Foreign Application Priority Data

Feb. 20, 1976 France ..... 7604813

[51] Int. Cl.[2] ..... B05B 15/00

[52] U.S. Cl. ..... 239/132.3; 239/533.3

[58] Field of Search ..... 239/5, 13, 132.1, 132.3, 239/120, 533.3

[56] References Cited

U.S. PATENT DOCUMENTS 2,425,229 8/1947 Bremser ..... 239/132.3

3,460,760 8/1969 Bluhm ..... 239/132.3

FOREIGN PATENT DOCUMENTS 167,276 2/1933 Switzerland ..... 239/132.3

446,274 4/1936 United Kingdom ..... 239/132.3

*Primary Examiner*—John J. Love

*Attorney, Agent, or Firm*—Kenyon & Kenyon, Reilly, Carr & Chapin

[57] ABSTRACT

The invention relates to a method and a device for obviating the risk of injection fuel leakage into the cooling system of Diesel engine injectors in the region of the glazed mating surfaces of the injector nozzle body and nozzle holder traversed by a fuel intake passage and by at least one liquid coolant inlet passage and one liquid coolant return passage, wherein is provided, at the plane defined by said glazed surfaces, leakage-fuel recovery passages drilled between the said fuel intake passage and the said cooling passages and having no communication therewith.

6 Claims, 6 Drawing Figures

Figure 1:
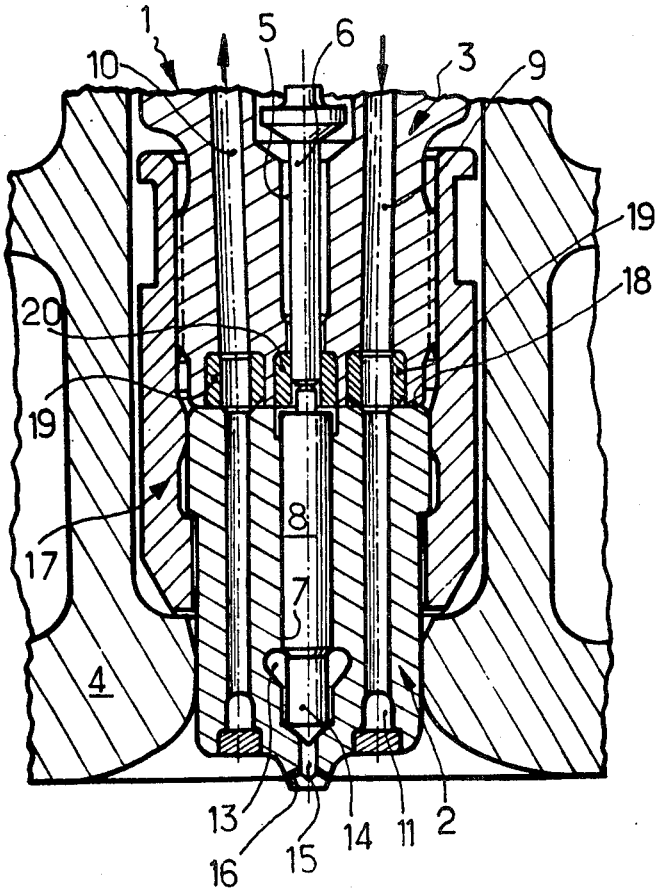

METHOD AND DEVICE FOR OBVIATING THE RISK OF INJECTION FUEL LEAKAGE, MORE PARTICULARLY INTO THE COOLING SYSTEM OF DIESEL ENGINE INJECTORS

The present invention has for its object a method and a device for obviating the risk of injection fuel leakage, more particularly into the cooling system of Diesel engine injectors, especially between the glazed mating surfaces that insure the fluid-tightness between the injector nozzle body and nozzle holder.

An injector of conventional type is made up of a nozzle body and a nozzle holder, each traversed by a central bore which accomodates the injector needle and push-rod, respectively, by a fuel intake passage and, in the case of a cooled injector, by at least one liquid coolant inlet passage and at least one liquid coolant return passage. The said passages pass through the said glazed surfaces, i.e. through the contact region between the nozzle body and the nozzle holder. If, therefore, the fluid-tightness between the said glazed surfaces is not perfect for some reason or another, the injection fuel, which is at a relatively high pressure, tends to spread between the glazed surfaces in three possible directions:

— out of the injector, which is of no immediate consequence but should nevertheless be avoided, — into the injector, more particularly into the central bore that insures the return of the needle leakage fuel, which in fact is preferable, and — towards the cooling system passages of the injector, which is absolutely undesirable.

Indeed, the mixing, in the latter case, of fuel with the liquid coolant, e.g. the water, in the cooling system will result in polluting the whole of the cooling system which is common to at least all the injectors of the engine, which may lead to poor cooling as a result of degraded circulation and deteriorated convection on the walls of the conduit, and which, moreover, does not allow the leaking injector or injectors to be readily located.

The present invention is directed at obviating the above mentioned major drawbacks, which may have serious consequences, especially where the cooling system is common to the injectors and the exhaust valves.

To this end, the invention provides means for deviating the leakage fuel before it reaches the cooling passages, thereby preventing the pollution of the cooling system.

The invention therefore provides a method for obviating the risk of injection fuel leakage, more particularly into the cooling system of a Diesel engine injector in the region of the glazed mating surface between the injector nozzle body and nozzle holder traversed by a fuel intake passage, by a central bore accommodating the injector push-rod and needle, and by at least one liquid coolant inlet passage and one liquid coolant return passage, characterized in that it consists in providing, at the plane defined by the said glazed surfaces of the injector, leakage fuel recovery passages drilled between the said fuel intake passage and the said cooling passages and having no communication therewith.

According to one feature of the invention, the method consists in surrounding each cooling passage with an annular leakage-fuel recovery passage having no communication with the said cooling passage.

According to another feature of the invention, the method consists in isolating the said fuel intake passage from the said cooling passages through the medium of, for example, two radial passages extending on either side of the said fuel intake passage.

According to another feature of the invention, the method consists in connecting the said recovery passages with the injector central bore which, in a manner known per se, insures the return of the injector leakage fuel.

The invention also provides a device for obviating the risk of injection fuel leakage, more particularly into the cooling system of a Diesel engine injector at the glazed mating surfaces of the injector nozzle body and nozzle holder traversed by a fuel intake passage, by a central bore accommodating the injector push-rod and needle, and by at least one liquid coolant intake passage and one liquid coolant return passage, characterized in that leakage fuel recovery passages are provided at the plane defined by the said mating surfaces of the injector, the said recovery passages being drilled between the said fuel intake passage and the said cooling passages and having no communication therewith.

According to another feature of the device, radial passages are provided to allow the said recovery passages to communicate with the said central bore of the injector insuring the return of the leakage fuel.

Figure 5:
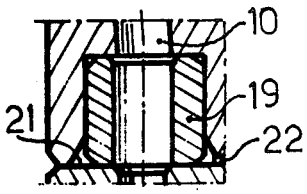
Figure 6:
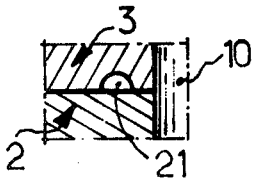
Figure 2:
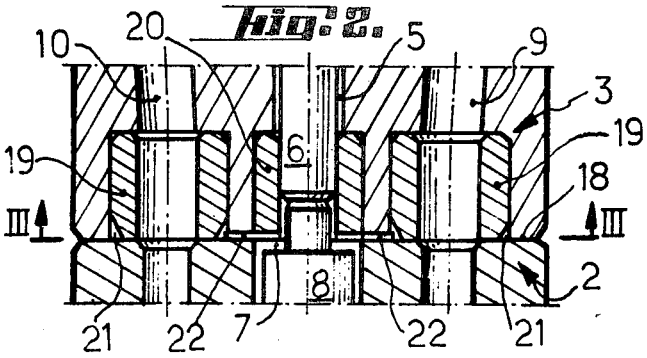
Figure 3:
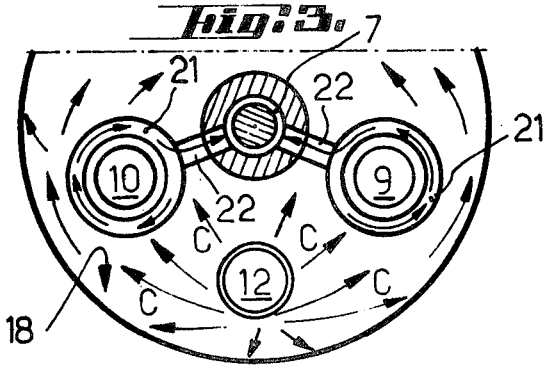
Figure 4:
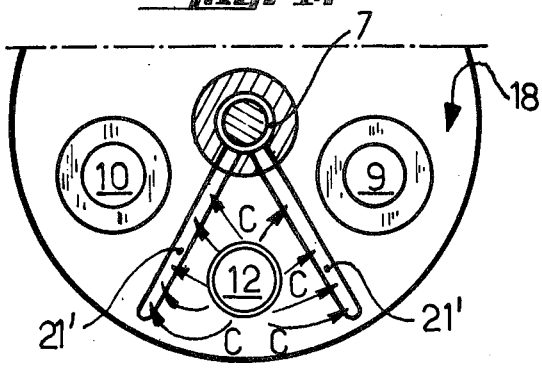

Other advantages, features and details of the invention will appear more clearly from the following explanatory description made with reference to the appended drawings given solely by way of example and wherein:

FIG. 1 is a fragmentary longitudinal sectional view of an injector according to the invention, FIG. 2 is an enlarged view of the region of the glazed surfaces of the injector of FIG. 1, FIG. 3 is a sectional view upon III—III of FIG. 2 according to a first form of embodiment, FIG. 4 is a sectional view upon III—III of FIG. 2, illustrating a second form of embodiment, FIG. 5 is a partial view of FIG. 2, illustrating a first form of embodiment of a recovery passage surrounding each cooling passage according to the form of embodiment of FIG. 3, and FIG. 6 is a partial longitudinal sectional view illustrating a second form of embodiment of the recovery passage surrounding each cooling passage according to the form of embodiment of FIG. 3.

Referring to FIG. 1, there is partially shown an injector of a known type provided with a cooling system and used, for example, in a Diesel engine.

The injector 1 is made up of a nozzle body 2 and of a nozzle holder 3 secured in an engine cylinder head 4. In the nozzle holder 3 and the nozzle body 2 of the injector are respectively drilled a first central bore 5 accommodating the push-rod 6 of the injector, and a second central bore 7 guiding the needle 8 of the injector, the said bores extending in prolongation of one another.

The cooling system of injector 1 comprises at least one coolant inlet passage 9 and one coolant return passage 10 which pass through the injector nozzle holder 3 and nozzle body 2 and communicate with one another in the nozzle body 2 through the medium of an annular cavity 11. The injector nozzle holder 3 and nozzle body 2 are also traversed by a fuel intake passage 12 (FIG. 3) leading to an annular groove 13 surrounding the end 14 of the needle 8 housed in the nozzle body 2. The fuel flowing into the annular groove 13 may, depending on the movement of the needle 8, pass into a passage 15, extending in prolongation of the bore 7 of the nozzle body 2, and through atomizing holes 16 into the combustion chamber (not shown).

The nozzle body 2 and nozzler holder 3 are generally cylindrical in shape and held in contact with one another by means of a sleeve nut 17 screwed around the nozzle body and the nozzle holder in the region of their jointing plane 18 defined by the glazed, mutually confronting surfaces of the said body and holder.

The said glazed surfaces must insure a perfectly fluid-tight contact between the nozzle body 2 and the nozzle holder 3 of the injector 1.

Referring to FIG. 2, showing a portion of the injector 1 in the region of the jointing plane 18 defined by the glazed surfaces of the nozzle body 2 and the nozzle holder 3 of the injector, it is observed that, in the region of the nozzle holder 3 adjacent to the jointing plane 18, sleeves 19 are mounted around the cooling passages 9 and 10, and a sleeve 20 is mounted around the bore 5 machined in the nozzle holder 3 of the injector 1. The sleeves 19, 20, which are mounted in corresponding bores provided in the nozzle holder 3, open on to the jointing surfaces 18 to improve the fluid-tightness at the cooling passages 9 and 10 and at the leakage-fuel return passage defined by the bores 7 and 5.

In the example illustrated, each cooling passage 9, 10, is surrounded, at the jointing plane 18 of the nozzle holder 3 and the nozzle body 2, with an annular recovery passage 21 obtained by chamfering the sleeves 19 at their end surfaces adjacent to the jointing plane 18. Each annular passage 21 communicates through a radial passage 22 drilled in the nozzle holder 3 of the injector with the leakage-fuel return passage 5, 7 of the injector 1.

FIG. 5 illustrates another form of embodiment of the annular passages 21 which, in this case, are machined also in the nozzle holder 3 of the injector 1, but outside the sleeves 19.

In FIG. 6, where no intermediate sleeve is provided at the crossing of each cooling passage between the nozzle holder 3 and the nozzle body 2, the annular passages or grooves 21 are machined in the nozzle holder 3 and may as well be machined in the nozzle body 2 and even partly in the nozzle holder 3 and partly in the nozzle body 2, but always at the jointing plane 18 of the injector nozzle holder and nozzle body.

Referring to FIG. 4, there is illustrated a second form of embodiment of the recovery passages at the jointing surfaces 18 of the injector nozzle body and nozzle holder. In this case, on either side of the fuel intake passage 12 are machined radial passages 21' which do not communicate therewith, but each of which communicates with the leakage-fuel return passage 5, 7 of the injector 1. These radial recovery passages extend substantially to the periphery of the jointing plane 18 of the injector nozzle body and nozzle holder.

Referring to FIGS. 3, 4, should fuel leakage occur from the fuel intake passage 12 in the jointing region 18 defined by the glazed surfaces of the nozzle body 2 and the nozzle holder 3 of the injector 1, the leakage fuel will, as shown by arrows C, spread in all directions, i.e. either directly out of the injector or towards the leakage-fuel return passage 5, 7 or towards the annular passages 21 surrounding the cooling passages 9 and 10 (FIG. 3), or towards radial passages 21' surrounding the fuel intake passage (FIG. 4). Once channelled by the recovery passages, the fuel returns to the leakage-fuel return passage, either through the medium of the radial passages 22 (FIG. 3) or directly through the passages 21' (FIG. 4).

In this manner, the leakage fuel in the jointing plane 18 between the injector nozzle body and nozzle holder are prevented from reaching the cooling passages 9 and 10 and thereby polluting the cooling system.

Thus, in the case of a cooling system common to the injectors and the exhaust valves, the liquid coolant in the injectors is reliably protected from pollution, thus insuring a good cooling of the exhaust valves.

Moreover, a device according to the invention allows the leaking injector or injectors to be quickly located through the medium of the leakage-fuel return passage, which was not the case hitherto, for most of the leakage fuel reached the cooling system associated with all the injectors, so that the leaking injectors could not be identified.

Of course, the invention is by no means limited to the forms of embodiment described and illustrated which have been given by way of example only. In particular it comprises all the means constituting technical equivalents to the means described as well as their combinations should the latter be carried out according to its gist and used within the scope of the following claims.

What is claimed is:

1. A diesel engine fuel injector having an elongated injector nozzle body, a nozzle holder at one end of said body, the body and holder having glazed mating surfaces in a plane transverse to the longitudinal axis of the nozzle body, a bore through the body and holder, an injector push rod and needle in said bore, a fuel leakage recovery passage in the holder, and coolant inlet and return passages extending lengthwise of the body and holder across said transverse plane, the coolant passages being spaced from the fuel leakage recovery passage, wherein the improvement comprises a counterbored section in each of the coolant inlet and return passages in one of the injector nozzle body and holder adjacent said transverse plane;

a sleeve fitted tightly in each of said counterbored sections so that one end thereof terminates at said plane;

an annular relief passage being provided adjacent the outer periphery of each sleeve at said one end; and channels at least one of said mating surfaces communicating between each of said annular grooves and the leakage fuel recovery passage to provide a low pressure fuel leakage return path and prevent fuel contamination of the coolant.

2. A device as per claim 1 wherein said counterbored sections are provided in said nozzle holder.

3. A device as per claim 1 in which each of said sleeves has a chamfer at its periphery at said one end to define said annular relief passage.

4. A device as per claim 3 wherein each of said sleeves has a chamfer at its periphery at its other end.

5. A device as per claim 1 wherein said channels comprise grooves in the glazed surface of said one of the injector nozzle body and the holder.

6. A device as per claim 1 wherein said channels comprise grooves in the glazed surface of said holder.

* * * * *

UNITED STATES PATENT AND TRADEMARK OFFICE

CERTIFICATE OF CORRECTION

PATENT NO. : 4,094,465

DATED : June 13, 1978

INVENTOR(S) : Dirk Bastenhof

It is certified that error appears in the above-identified patent and that said Letters Patent are hereby corrected as shown below:

Column 3, line 3: change "nozzler" to --nozzle--.

Column 4, line 47: after "channels" insert --in--.

Signed and Sealed this

*Second* Day of *January 1979*

[SEAL]

*Attest:*

RUTH C. MASON
*Attesting Officer*

DONALD W. BANNER
*Commissioner of Patents and Trademarks*